US011675300B2

(12) United States Patent
Horie et al.

(10) Patent No.: US 11,675,300 B2
(45) Date of Patent: Jun. 13, 2023

(54) IMAGE FORMING APPARATUS WITH CONVEYANCE SWITCHING DEVICE FOR ENDLESS BELT

(71) Applicant: HEWLETT-PACKARD DEVELOPMENT COMPANY, L.P., Spring, TX (US)

(72) Inventors: Takayuki Horie, Yokohama (JP); Koichi Utsunomiya, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/563,584

(22) Filed: Dec. 28, 2021

(65) Prior Publication Data

US 2022/0350283 A1 Nov. 3, 2022

(30) Foreign Application Priority Data

Apr. 28, 2021 (JP) ..... JP2021-075927

(51) Int. Cl.
*G03G 15/20* (2006.01)

(52) U.S. Cl.
CPC . *G03G 15/2064* (2013.01); *G03G 2215/2032* (2013.01)

(58) Field of Classification Search
CPC ..... G03G 15/2064; G03G 2215/2032
See application file for complete search history.

(56) References Cited

U.S. PATENT DOCUMENTS

| | | | | |
|---|---|---|---|---|
| 5,164,782 A * | 11/1992 | Nagayama | ..... | G03G 15/2064 430/124.3 |
| 2009/0154943 A1* | 6/2009 | Ciaschi | ..... | G03G 15/2064 399/329 |
| 2010/0226681 A1 | 9/2010 | Okuda | | |

FOREIGN PATENT DOCUMENTS

| | | |
|---|---|---|
| JP | 8-290857 | 11/1996 |
| JP | 2003-137467 | 5/2003 |
| JP | 2009-98424 | 5/2009 |
| JP | 2016-177247 | 10/2016 |

* cited by examiner

*Primary Examiner* — Sevan A Aydin
(74) *Attorney, Agent, or Firm* — Foley & Lardner LLP

(57) ABSTRACT

An image forming apparatus includes a fixing device that includes an endless belt to convey a print medium, a heating roller to heat the endless belt, a pressing roller that presses the endless belt against the heating roller along a nip region of the endless belt, and a conveyance switching device to move the endless belt between a first position that directs the print medium away from the endless belt when the print medium exits the nip region, and a second position that conveys the print medium to remain in contact with the endless belt when the print medium exits the nip region.

15 Claims, 10 Drawing Sheets

IMAGE FORMING APPARATUS WITH CONVEYANCE SWITCHING DEVICE FOR ENDLESS BELT

CROSS REFERENCE TO RELATED APPLICATIONS

This application claims priority benefit from Japanese Patent Application No. 2021-075927 filed on Apr. 28, 2021, the contents of which are incorporated herein by reference.

BACKGROUND ART

An image forming apparatus includes a fixing device that fixes a toner image to a paper by heating and pressing the paper to which the toner image has been transferred. Some image forming apparatuses include a gloss processing device that adds a gloss finish to a fixed toner image. In the gloss processing device, the paper having the toner image is heated and pressed between a pair of rollers and is conveyed on a belt for cooling, while a surface of the paper having the toner image remains in contact with the endless belt.

DETAILED DESCRIPTION

An example image forming apparatus includes a fixing device. The fixing device includes an endless belt that conveys a print medium, a heating roller which heats the endless belt, a pressing roller which forms a nip region by pressing the endless belt against the heating roller, and a conveyance switching device which moves the endless belt between a first position in which the print medium is separated from the endless belt when the print medium comes out of the nip region and a second position in which the print medium is conveyed while being in contact with the endless belt when the print medium comes out of the nip region.

Another example fixing device includes an endless belt which conveys a print medium, a pressure-heating device which engages with the endless belt and fixes a toner image to the print medium, a suspension roller which is disposed inside the endless belt and conveys the print medium along a gloss-forming path of the endless belt located between the suspension roller and the pressure-heating device, and a conveyance switching device which switches a conveyance direction of the print medium to a first conveyance direction moving away from the gloss-forming path of the endless belt and a second conveyance direction following the gloss-forming path of the endless belt.

Accordingly, since it is possible to change the flow of the print medium having passed through the nip region, it is possible to selectively form a gloss-processed image and a non-gloss-processed image even when a gloss processing device is not provided separately from the fixing device.

Hereinafter, an example image forming apparatus will be described with reference to the drawings. In the following description, with reference to the drawings, the same reference numbers are assigned to the same components or to similar components having the same function, and overlapping description is omitted.

Figure 1:
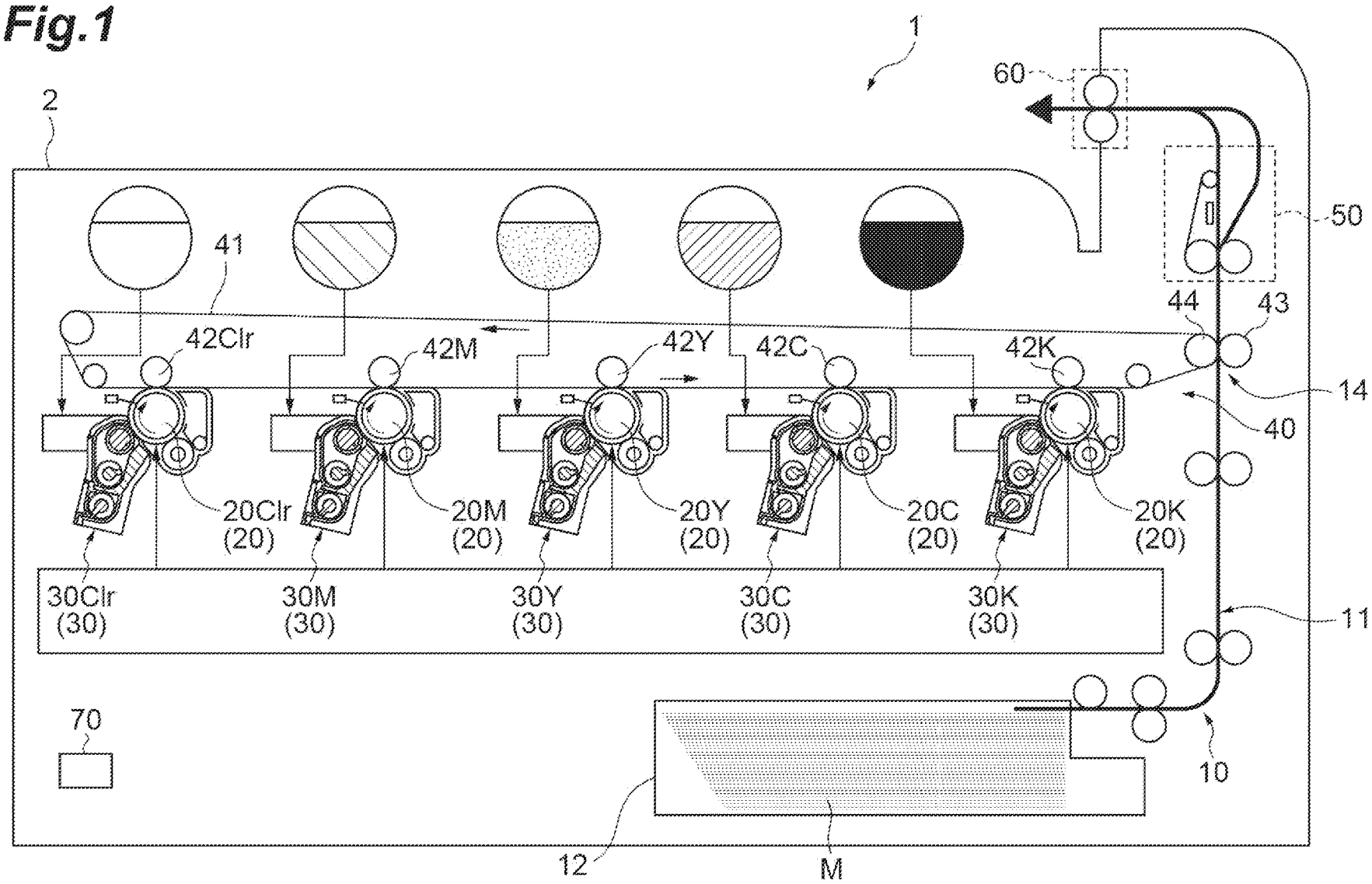
FIG. 1 is a schematic diagram of an example image forming apparatus including a fixing device.

With reference to FIG. 1, an example image forming apparatus 1 may form a color image using four colors of toner, including magenta, yellow, cyan, and black, in addition to a clear toner, in order to impart gloss to the color image. The clear toner may be a transparent toner, a translucent toner, or a colored toner. The image forming apparatus 1 includes a conveying device 10, a plurality of image carriers (e.g., photoconductor drums) 20, a plurality of developing devices 30, a transfer device 40, a fixing device 50, a discharge device 60, and a controller 70.

The conveying device 10 conveys a paper (e.g., a sheet of paper) M which is a recording medium on which an image is to be formed, along a conveying path 11. The paper M is initially stored in a cassette 12 in a stacked state and is picked up and conveyed by a feeding roller of the conveying device 10.

Each of the plurality of image carriers 20 forms an electrostatic latent image on a surface (peripheral surface). The plurality of image carriers 20 include image carriers 20Clr, 2DM, 20Y, 20C, and 20K. The image carrier 20Clr, 20M, 20Y, 20C, and 20K form respective electrostatic latent images in order to form a clear toner image, a magenta toner image, a yellow toner image, a cyan toner image, and a black toner image, respectively. The image carriers 20Clr, 2DM, 20Y, 20C, and 20K have substantially identical configurations, and will therefore be collectively described as the image carrier 20 unless specified otherwise. The image carrier 20 may also be referred to as an electrostatic latent image carrier, a photoconductor drum, or the like.

The plurality of developing devices 30 form toner images by developing the electrostatic latent images formed on the respective surfaces of the image carriers 20Clr, 20M, 20Y, 20C, and 20K. The plurality of developing devices 30 include developing devices 30Clr, 30M, 30Y, 30C, and 30K. The developing devices 30Clr, 30M, 30Y, 30C, and 30K are respectively disposed adjacent the image carriers 20Clr, 20M, 20Y, 20C, and 20K to develops the electrostatic latent images, with clear toner, magenta toner, yellow toner, cyan toner, and black toner, respectively. Since the developing devices 30Clr, 30M, 30Y, 30C, and 30K have substantially the same configurations, they will be collectively described as the developing device 30 unless specified otherwise.

The transfer device 40 conveys the toner images respectively developed by the developing devices 30Clr, 30M, 30Y, 30C, and 30K and transfers the toner images to the paper M. The transfer device 40 includes a transfer belt 41, primary transfer rollers 42Clr, 42M, 42Y, 42C, and 42K, and secondary transfer rollers 43 and 44. The primary transfer rollers 42Clr, 42M, 42Y, 42C, and 42K primarily transfer the toner images from the image carriers 20Clr, 20M, 20Y, 20C, and 20K, respectively, to the transfer belt 41, so as to layer the toner images into a single composite toner image. The secondary transfer rollers 43 and 44 secondarily transfer the composite toner image from the transfer belt 41 to the paper M.

The fixing device 50 fixes the toner image on the paper M to the paper M by heating and pressing the paper M to which the composite toner image has been transferred. The fixing device 50 will be described in detail later.

The discharge device 60 discharges the paper M including the fixed toner image to the outside of the apparatus.

The controller 70 is an electronic control device which includes a central processing unit (CPU), a read only memory (ROM), a random access memory (RAM), and the like. In the controller 70, various controls are performed in such a manner that a program stored in the ROM is loaded onto the RAM and is executed by the CPU, The controller 70 may be configured as a plurality of electronic control device or a single electronic control device. The controller 70 performs various controls in the image forming apparatus 1.

Figure 2:
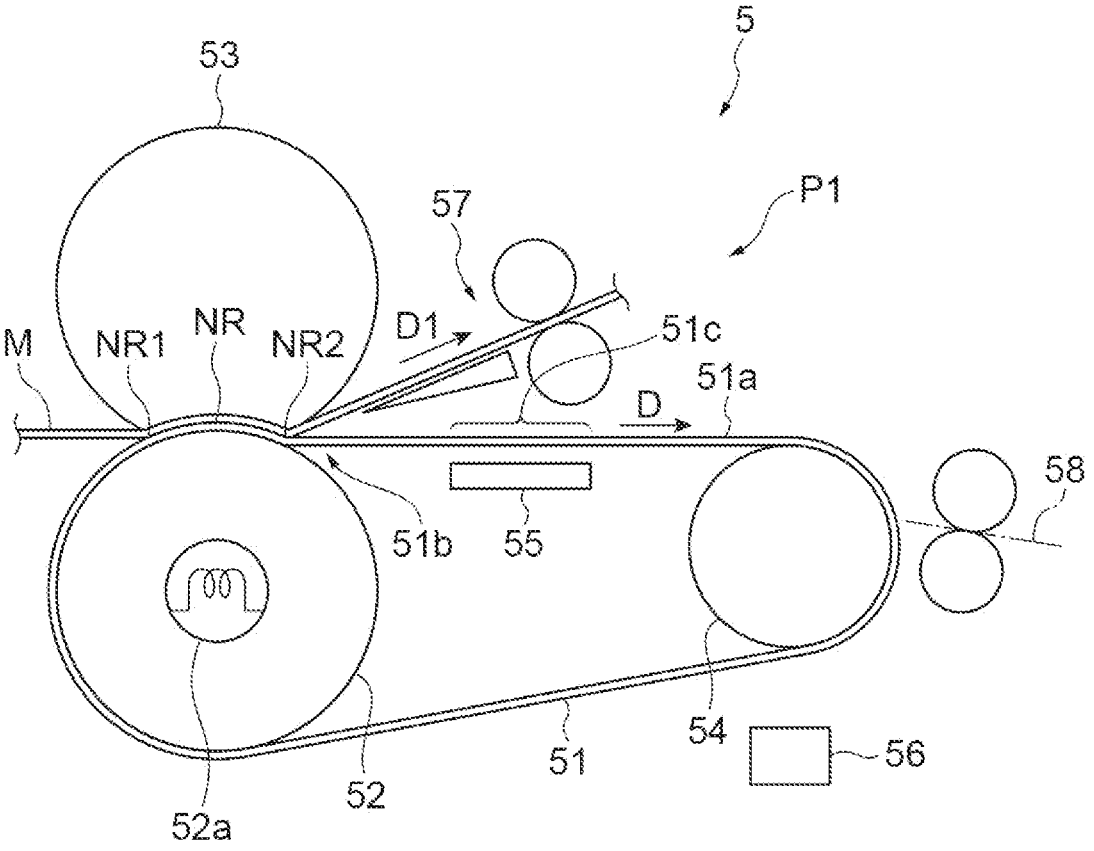
FIG. 2 is a schematic view showing the example fixing device of FIG. 1, shown in a first position.
Figure 3:
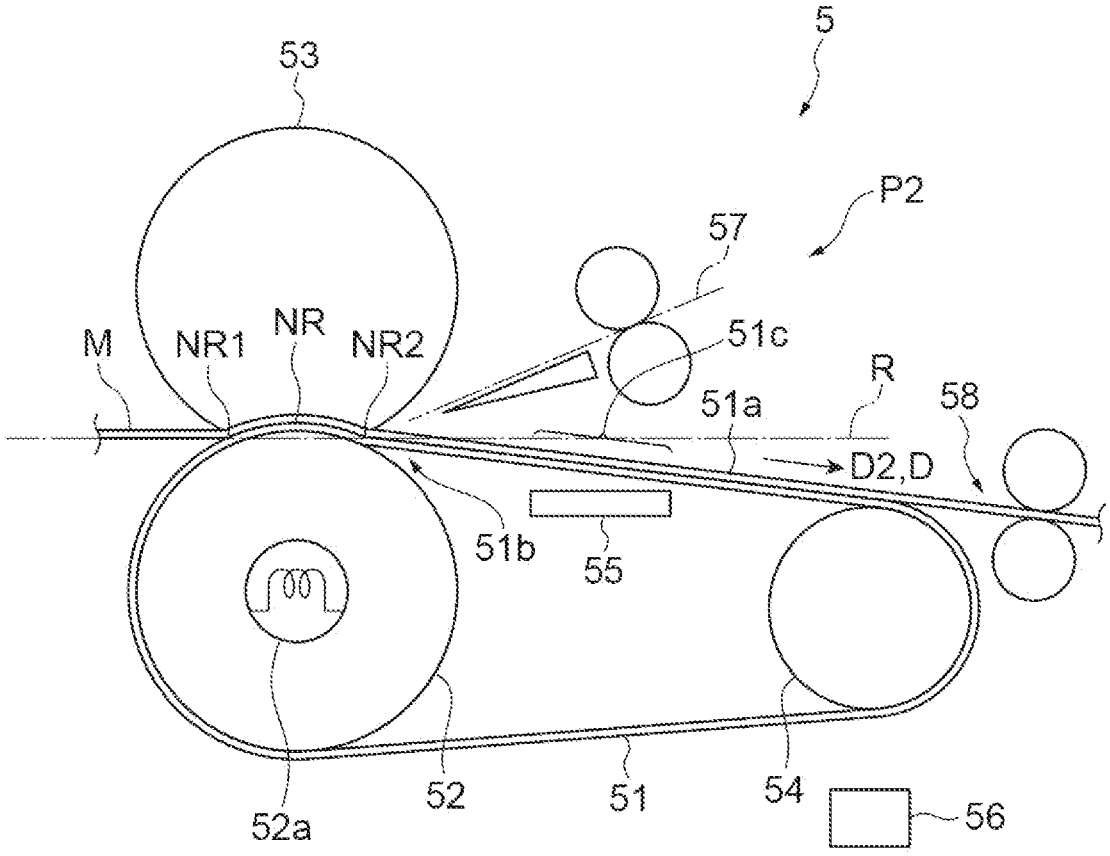
FIG. 3 is a schematic view showing the example fixing device of FIG. 2, shown in a second position.

As shown in FIGS. 2 and 3, an example fixing device 50 includes an endless belt 51 that conveys the paper M, a heating roller 52, a pressing roller 53, a suspension roller 54, a cooling device 55, and a conveyance switching device 56 to switch a conveyance of the paper M between a first conveying path 57 and a second conveying path 58. It should be noted that the conveyance switching device 56 is shown as a block in FIGS. 2 and 3.

The endless belt 51 is extends around the heating roller 52 and the suspension roller 54. Accordingly, the heating roller 52 and the suspension roller 54 are disposed inside the endless belt 51. The heating roller 52 may correspond to a first belt roller for suspending the endless belt 51 and the suspension roller 54 may correspond to a second belt roller for suspending the endless belt 51. The endless belt 51 is rotationally driven by the rotation of the heating roller 52 and the suspension roller 54 and conveys the paper M located on the outer peripheral side of the endless belt 51 in a conveyance direction D from the heating roller 52 toward the suspension roller 54. The endless belt 51 has a smooth outer peripheral surface 51*a*. The endless belt 51 is also called a smoothness imparting belt and can impart smoothness to the toner image by positioning the paper M so that the toner image is in contact with the outer peripheral surface 51*a* and by melding and cooling the toner of the toner image.

The heating roller 52, the pressing roller 53, and the suspension roller 54 are rotatable around respective rotational axes. The heating roller 52 may be a drive roller which is driven to rotate, and the pressing roller 53 and the suspension roller 54 may be driven rollers which rotate in a following manner by the rotation of the heating roller 52 via a rotation of the endless belt 51.

The heating roller 52 heats the paper M. The heating roller 52 includes a heating device 52*a* for heating the paper M. The heating device 52*a* is disposed, for example, inside the heating roller 52.

The pressing roller 53 presses the endless belt 51 and the paper M against the heating roller 52. The pressing roller 53 is disposed outside the endless belt 51 to face the heating roller 52. The pressing roller 53 is supported by a support member (not shown) to be pressed against the heating roller 52. The pressing roller 53 has an elastically deformable outer peripheral portion, so that a nip region NR for fixing the toner image to the paper M, is formed along the endless belt 51 between the pressing roller 53 and the heating roller 52.

The nip region NR extends from a first end NR1 forming an inlet of the nip region NR, to a second end NR2 forming an outlet of the nip region NR, in the conveyance direction D. Accordingly, the first end NR1 is an upstream end of the nip region NR, and the second end NR2 is a downstream end of the nip region NR, in the conveyance direction D of the endless belt 51. The paper M is conveyed to the nip region NR such that the toner image on the paper M contacts the outer peripheral surface 51*a* of the endless belt 51. In the nip region NR, the endless belt 51 and the paper M are heated and pressed by the heating roller 52 and the pressing roller 53 so that the toner image on the paper M is fixed to the paper M.

The heating roller 52 and the pressing roller 53 form a pressure-heating device which engage with the endless belt 51 and fix the toner image to the paper M. The pressing roller 53 and the support member that supports the pressing roller 53 form a pressing device which is disposed outside the endless belt 51 to press the endless belt 51 against the heating roller 52 along the nip region NR of the endless belt 51.

The suspension roller 54 supports the endless belt 51 together with the heating roller 52. The suspension roller 54 is disposed on the downstream side of the nip region NR in the conveyance direction D of the endless belt 51, from the heating roller 52 toward the suspension roller 54. The endless belt 51 includes a nip outlet portion 51*b* adjacent and downstream the second end NR2 of the nip region NR. That is, the nip outlet portion 51*b* of the endless belt 51 extends downstream from the second end NR2, in the conveyance direction D. The endless belt 51 rotates during operation to convey the paper M, and accordingly, the nip outlet portion 51*b* of the endless belt 51*c* orresponds to a relative position along the endless belt 51, with respect to the nip region NR.

The cooling device 55 is disposed adjacent to the endless belt 51 to cool a portion of the endless belt 51 between the heating roller 52 and the suspension roller 54 in the conveyance direction D, in order to impart gloss to the toner image on the paper M. The portion which is cooled by the cooling device 55 may be referred to as a gloss-forming path 51*c*. The suspension roper 54 conveys the paper M along the gloss-forming path 51*c* of the endless belt 51. The cooling device 55 is disposed adjacent to the gloss-forming path 51*c* to cool the gloss-forming path 51*c*. The cooling device 55 includes, for example, a cold air fan or the Ike that blows cold air from the inside of the endless belt 51 onto the endless belt 51. The toner image on the paper M may not be fully cured immediately after the paper M is discharged from the nip region NR. Consequently, when the paper M is conveyed to the gloss-forming path 51*c* of the endless belt 51 with the toner image contacting the outer peripheral surface 51*a* of the endless belt 51, the paper M and the toner image are cooled so that the toner image on the paper M forms a smooth surface. Accordingly, gloss is imparted to the toner image on the paper M. Such a process of smoothening the toner image on the paper M by conveying the paper M to the gloss-forming path 51*c* of the endless belt 51 while the toner image on the paper M is in contact with the outer peripheral surface 51*a* of the endless belt 51 may be referred to as gloss processing.

The conveyance switching device 56 changes the conveying path of the paper M discharged from the nip region NR. The conveyance switching device 56 moves the endless belt 51 between a first position P1 ((cf. FIG. 2) and a second position P2 (cf. FIG. 3). With reference to FIG. 2, in the first position P1, the paper M is separated (peeled off) from the endless belt 51 when the paper M exits the nip region NR. With reference to FIG. 3, in the second position P2, the paper M is conveyed while remaining in contact with the endless belt 51 when the paper M exits the nip region NR. In other words, the conveyance switching device 56 switches the conveyance direction of the paper M to the first conveyance direction D1 in the first position P1, and to the second conveyance direction D2 in the second position P2. With reference to FIG. 2, the first conveyance direction D1 extends away from the gloss-forming path 51*c* of the endless belt 51, With reference to FIG. 3, the second conveyance direction D2 follows the gloss-forming path 51*c* of the endless belt 51. The second conveyance direction D2 corresponds to the conveyance direction D of the endless belt 51. The conveyance switching device 56 may switch the conveyance direction of the paper M between the first conveyance direction D1 and the second conveyance direction D2 for example, at least by moving the nip outlet portion 51*b* in the endless belt 51 between the first position P1 and the second position P2.

Figure 4:
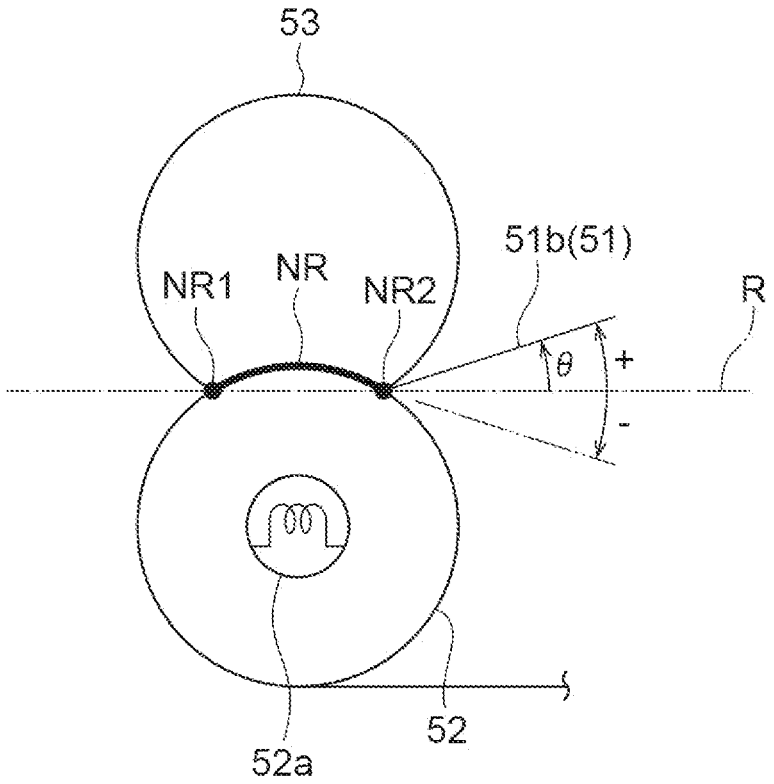
FIG. 4 is a schematic diagram illustrating an angle of a conveying belt with respect to a reference plane.

The conveyance switching device 56 is configured to change an angle θ (see FIG. 4) of the nip outlet portion 51*b* with respect to a reference plane R (see FIG. 4) in order to move the endless belt 51 between the first position P1 and the second position P2. As shown in FIG. 4, the reference plane R extends along (includes) the first end NR1 and the second end NR2 of the nip region NR. The angle θ of the nip outlet portion 51*b* with respect to the reference plane R corresponds to a positive angle when the angle θ extends from the reference plane R toward the outer peripheral side of the endless belt 51 (e.g., the side of the reference plane R that faces the pressing roller 53) and corresponds to a negative angle when the angle θ extends from the reference plane R toward the inner peripheral side of the endless belt 51 (e.g., the side of the reference plane R that faces the heating roller 52). Additionally, the angle θ of the nip outlet portion 51*b* of the endless belt 51 with respect to the reference plane R at the first position P1 corresponds to a first angle, and the angle θ of the nip outlet portion 51*b* with respect to the reference plane R at the second position P2 corresponds to a second angle. Namely, the nip outlet portion 51*b* forms the first angle with respect to the reference plane R in the first position P1 of the endless belt 51, and forms the second angle with respect to the reference plane R in the second position P2 of the endless belt 51.

As previously described, the paper M is heated and pressed in the nip region NR, so that the paper M is discharged from the nip region NR with the toner image on the paper M remaining in contact with the outer peripheral surface 51*a* of the endless belt 51. When the endless belt 51 is bent toward a side in which the angle θ formed at the second end NR2 of the nip region NR is positive, the paper M is more easily peeled off from the endless belt 51 at the second end NR2. Additionally, the ease of peeling off the paper M from the endless belt 51 increases as the positive angle of the endless belt 51 increases, namely when the angle θ of the nip outlet portion 51*b* with respect to the reference plane R increases. Accordingly, the conveyance switching device 56 can control the fixing device to carry out an operation of separating the paper M from the endless belt 51 when the paper M exits the nip region NR, or to carry out an operation of maintaining the paper M in contact with the endless belt 51 when the paper M exits the nip region NR, by changing the angle θ of the nip outlet portion 51*b* with respect to the reference plane R. Namely, by changing the angle θ of the nip outlet portion 51*b* with respect to the reference plane R, the conveyance switching device 56 can switch between an operation of conveying the paper M in a direction moving away from the gloss-forming path 51*c* of the endless belt 51, and an operation of conveying the paper M in a direction following the gloss-forming path 51*c* of the endless belt 51.

Figure 5:
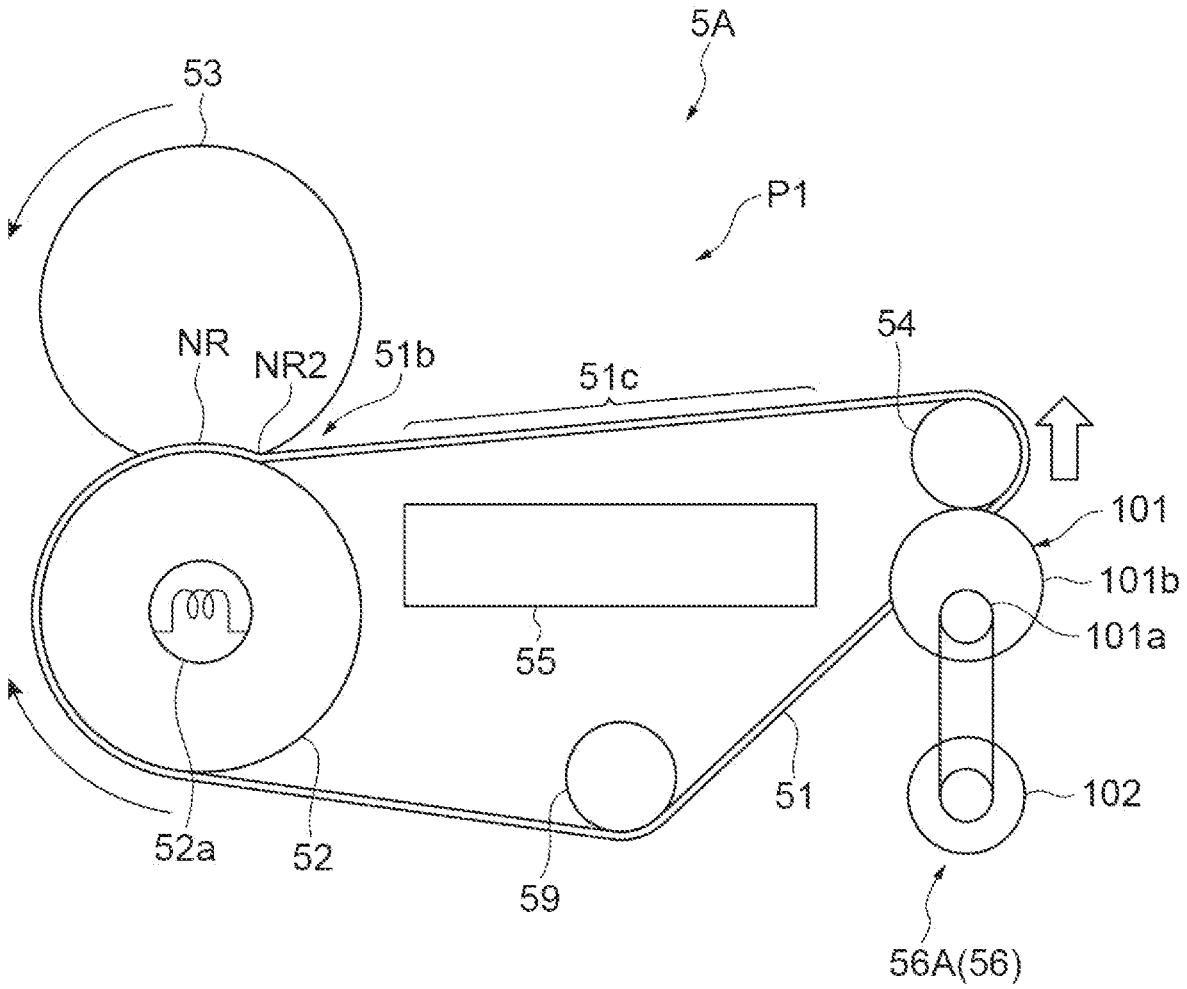
FIG. 5 is a schematic diagram of a fixing device including an example conveyance switching device, shown in a first position.
Figure 6:
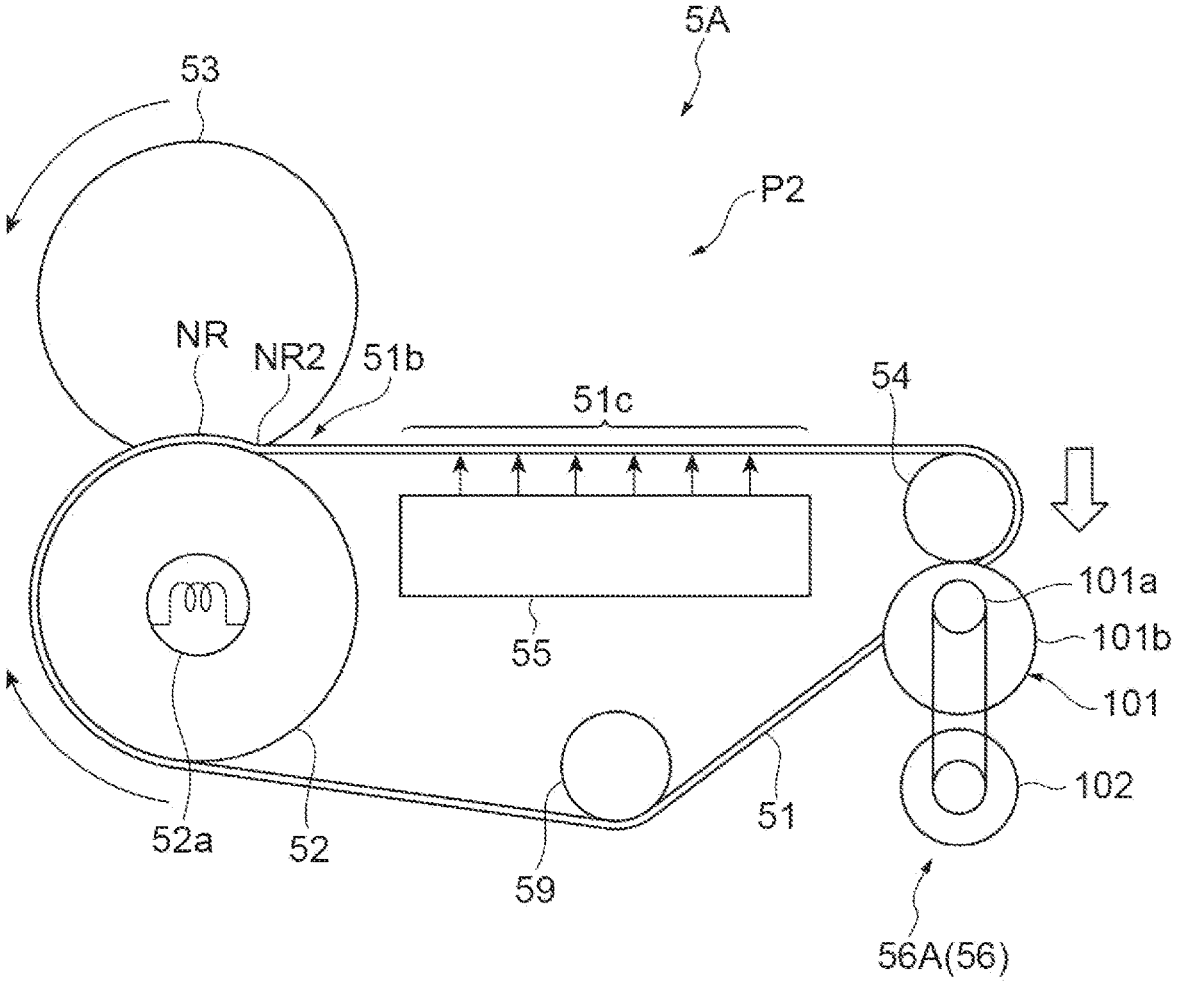
FIG. 6 is a schematic diagram of the example fixing device of FIG. 5, illustrating a second position of the conveyance switching device.

FIGS. 5 and 6 illustrate a fixing device 5A including an example conveyance switching device 56A. FIG. 5 shows a state in which the conveyance switching device 56A moves the endless belt 51 so that the endless belt 51 is in the first position P1 and FIG. 6 shows a state in which the conveyance switching device 56A moves the endless belt 51 so that the endless belt 51 is in the second position P2. The example fixing device 5A also includes a suspension roller 59 in addition to the suspension roller 54 such that the endless belt 51 is extends around the heating roller 52, the suspension roller 54, and the suspension roller 59. The example conveyance switching device 56A moves the suspension roller 54 with respect to the heating roller 52 or the pressing roller 53 in order to change the angle θ of the nip outlet portion 51*b* of the endless belt 51. Accordingly, the conveyance switching device 56A can move the suspension roller 54 with respect to the heating roller 52 and the pressing roller 53 in order to change the angle (or angular direction) of the gloss-forming path 51*c*.

The conveyance switching device 56A includes a cam 101 which can rotate to displace the suspension roller 54, and a motor 102 which rotates the cam 101. The cam 101 is an eccentric cam including a rotatable rotation shaft 101*a* and a cam portion 101*b* which is eccentric with respect to the rotation shaft 101*a*. The cam portion 101*b* contacts the suspension roller 54. The driving of the motor 102 is controlled by the controller 70 (cf. FIG. 1) and the rotation shaft 101*a* of the cam 101 is rotationally driven by the motor 102 so that the cam portion 101*b* moves the suspension roller 54. Accordingly, the conveyance switching device 56A changes the angle θ of the nip outlet portion 51*b* with respect to the reference plane R by moving the suspension roller 54 with respect to the heating roller 52 or the pressing roller 53.

Figure 7:
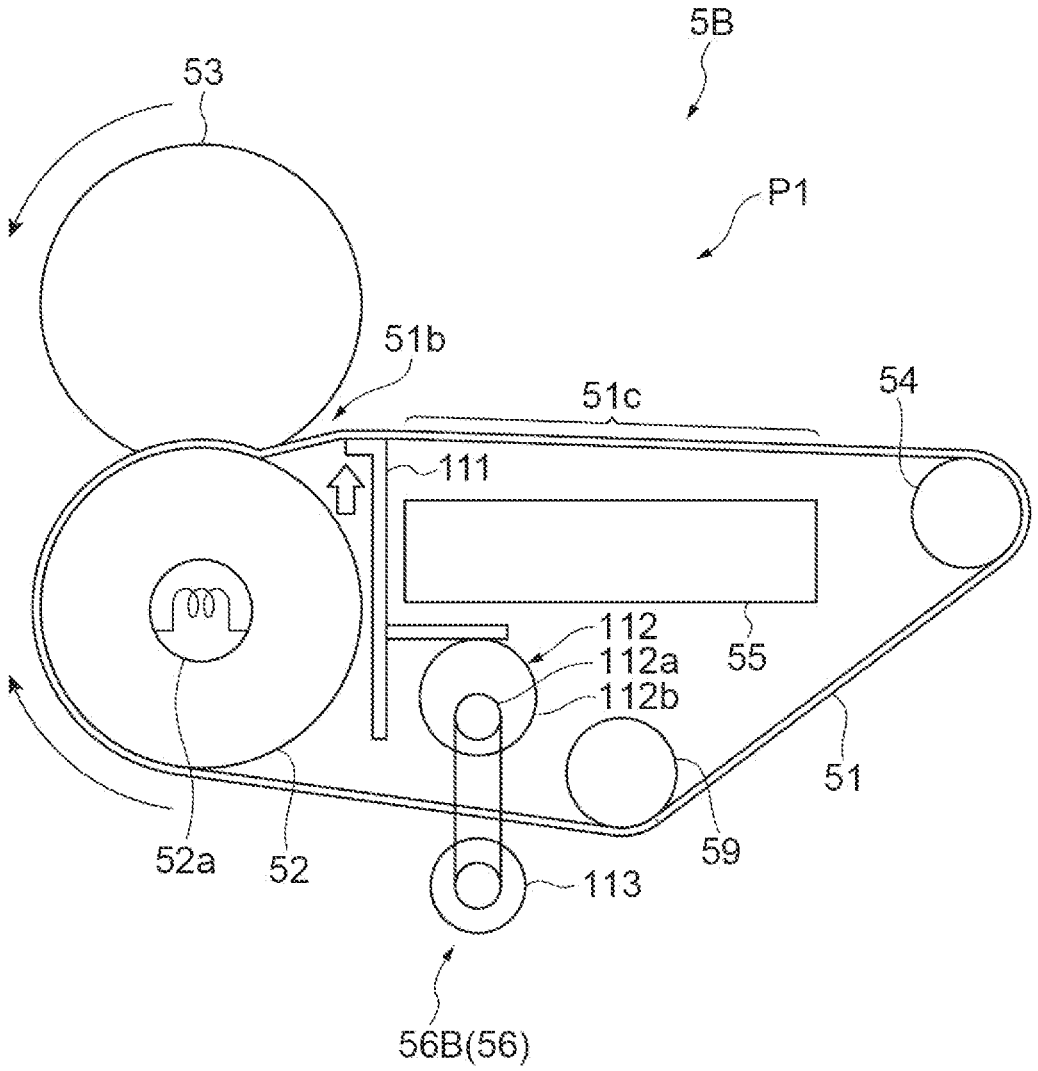
FIG. 7 is a schematic diagram of a fixing device including another example conveyance switching device, shown in a first position.
Figure 8:
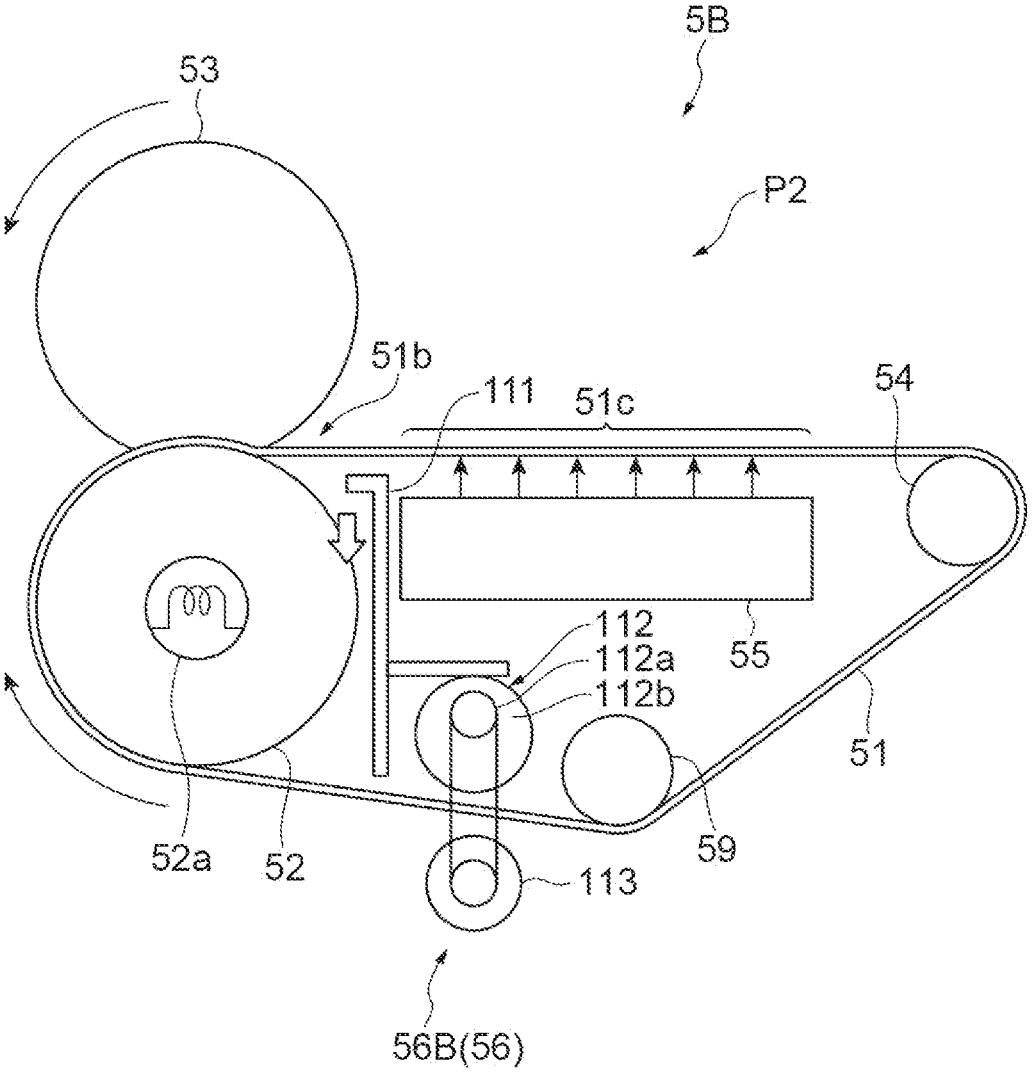
FIG. 8 is a schematic diagram of the example fixing device of FIG. 7, illustrating a second position of the conveyance switching device.

FIGS. 7 and 8 illustrate a fixing device 5B including another example conveyance switching device 56B. FIG. 7 shows a state in which the conveyance switching device 568 moves the endless belt 51 so that the endless belt 51 is in the first position P1 and FIG. 8 shows a state in which the conveyance switching device 568 moves the endless belt 51 so that the endless belt 51 is in the second position P2. The example fixing device 5B also includes a suspension roller 59 in addition to the suspension roller 54 such that the endless belt 51 extends around the heating roller 52, the suspension roller 54, and the suspension roller 59. The example conveyance switching device 56B can press against the endless belt 51 between the heating roller 52 and the suspension roller 54 from the inside of the endless belt 51, in order to change the angle θ of the nip outlet portion 51*b* of the endless belt 51. Namely, the conveyance switching device 56B press against the endless belt 51 from the inside of the endless belt 51 in order to change the angle of the gloss-forming path 51*c*.

The conveyance switching device 56B includes a belt pressing device 111 which is located inside the endless belt 51 between the heating roller 52 and the suspension roller 54, a cam 112 which rotates to displace the belt pressing device 111, and a motor 113 which rotates the cam 112. The belt pressing device 111 is movable toward and away from the endless belt 51. The cam 112 is an eccentric cam including a rotatable rotation shaft 112*a* and a cam portion 112*b* which is eccentric with respect to the rotation shaft 112*a*. The cam portion 112*b* may come into contact with the belt pressing device 111. The driving of the motor 113 is controlled by the controller 70 (cf. FIG. 1) and the rotation shaft 112*a* of the cam 112 is rotationally driven by the motor 113 so that the cam portion 112*b* moves the belt pressing device 111 toward and away from the endless belt 51. When the belt pressing device 111 moves to contact the endless belt 51 so as to apply tension to the endless 51 at a point of contact, a convex shape is formed in the endless belt 51 adjacent to the nip outlet portion 51*b*. Namely, the belt pressing device 111 forms a convex shape of the endless belt 51 between the heating roller 52 and the suspension roller 54 by pressing against the endless belt 51 from the inside of the endless belt 51. On the other hand, the belt pressing device 111 restores the linear shape of the endless belt 51 adjacent to the nip outlet portion 51*b* when moving away (or retracting) from the endless belt 51 so as to release the tension from the endless belt 51. Namely, the belt pressing device 111 restores an original or default shape of the endless belt 51 between the heating roller 52 and the suspension roller 54 when moving away from the endless belt 51.

As shown in FIGS. 2 and 3, the first conveying path 57 is disposed in the vicinity of the second end NR2 of the nip region NR. When the conveyance switching device 56 switches the endless belt 51 to the first position P1, the paper M peeled off from the endless belt 51 is conveyed along the first conveying path 57. The second conveying path 58 is disposed in the vicinity of the suspension roller 54. When the conveyance switching device 56 switches the endless belt 51 to the second position P2, the paper M peeled off from the endless belt 51 is conveyed along the second conveying path 58.

The controller 70 (cf. FIG. 1) operates the conveyance switching device 56 to adjust the angle θ of the nip outlet portion 51*b* with respect to the reference plane R. That is, when a print instruction to bypass gloss processing is input, then the controller 70 operates the conveyance switching device 56 to position the endless belt 51 in the first position P1. Accordingly, the paper M is separated from the endless belt 51 when exiting of the nip region NR such that gloss processing is not performed on the toner image on the paper M. On the other hand, when a print instruction to performing gloss processing is input, then the controller 70 operates the conveyance switching device 56 to position the endless belt 51 at the second position P2. Accordingly, since the paper M is in contact with the endless belt 51 when exiting the nip region NR, gloss processing is performed on the toner image on the paper M.

The angle θ of the nip outlet portion 51*b* with respect to the reference plane R that is suitable to cause the paper M to separate from the endless belt 51 when the paper M comes out of the nip region NR varies depending on the weight of the paper M, the composition of the toner forming the toner image, and the like. For this reason, the controller 70 may vary the angle θ of the nip outlet portion 51*b* with respect to the reference plane R in the first position P1 and in the second position P2 depending on the weight of the paper M, the composition of the toner forming the toner image, and the like.

Figure 9:
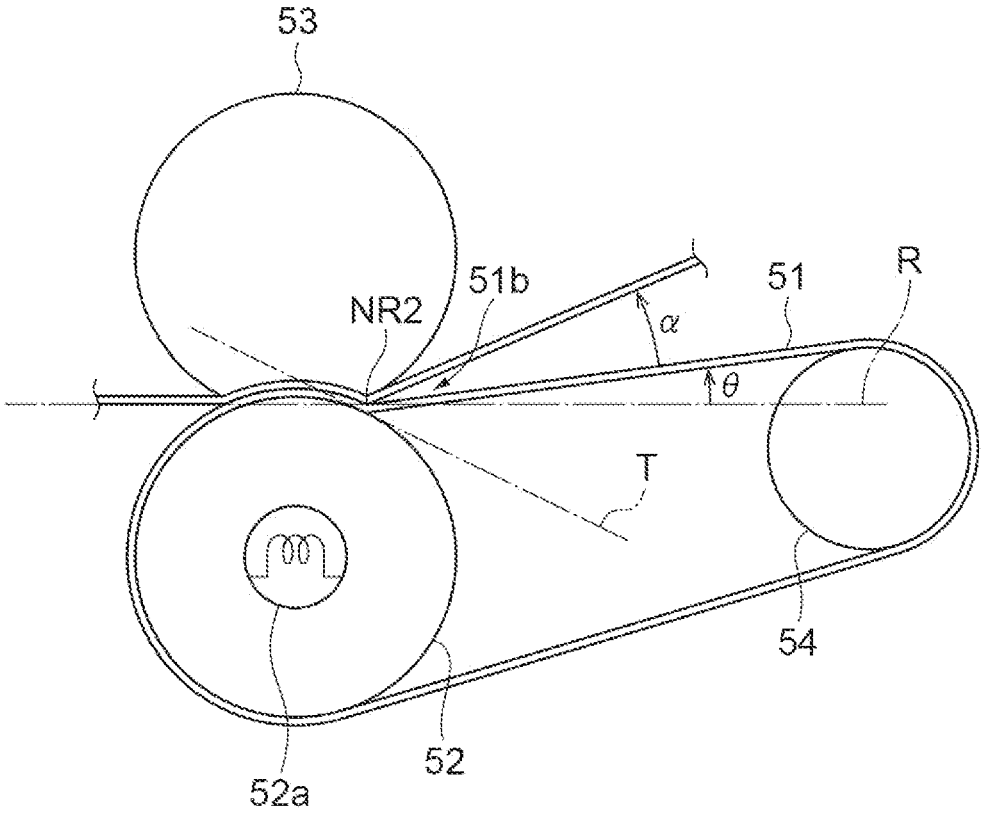
FIG. 9 is a schematic diagram of an example fixing device.
Figure 10:
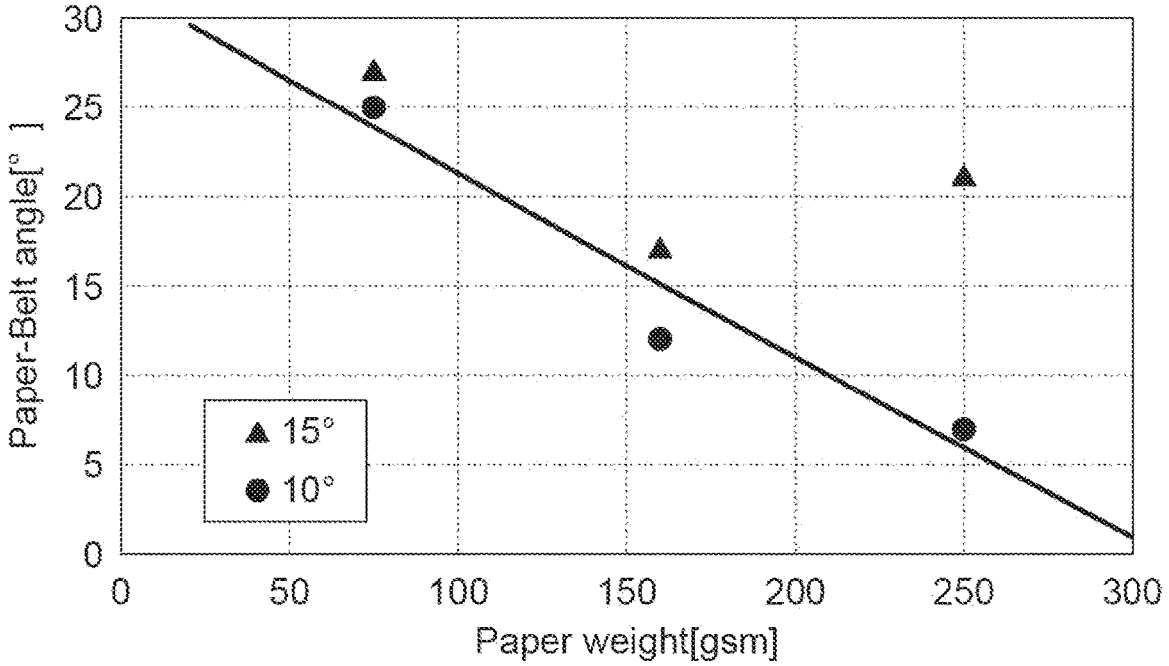
FIG. 10 is a graph showing a relationship between a paper weight and a paper peeling angle with respect to an endless belt.

With reference to FIG. 9, the angle θ of the nip outlet portion 51*b* with respect to the reference plane R and the peeling angle α of the paper M with respect to the endless belt 51 when the paper M exits the nip region NR were measured. In this measurement, three types of paper M such as a paper having a weight of 75 grams per square meter (gsm), a paper having a weight of 160 gsm, and a paper having a weight of 250 gsm were used. The measurement results are shown in FIG. 10. In FIG. 10, a circular mark indicates the measurement result when the angle θ of the nip outlet portion 51*b* with respect to the reference plane R was 10° and a triangular mark indicates the measurement result when the angle θ of the nip outlet portion 51*b* with respect to the reference plane R was 15°.

From the result shown in FIG. 10, it is assumed that the paper M can be peeled off from the endless belt 51 when exiting the nip region NR even for a sheet of paper having a weight of about 300 gsm, by setting the angle θ of the nip outlet portion 51*b* with respect to the reference plane R to at least 10° or more. For this reason, the first angle of the nip outlet portion 51*b* of the endless belt 51 with respect to the reference plane R at the first position P1 of the endless belt 51 may be 10° or more, 12° or more, or 14° or more, depending on examples. Further, the controller 70 may set the angle θ of the nip outlet portion 51*b* with respect to the reference plane R in the first position P1, to 10° or more in some examples, 12° or more in other examples, or 14° or more in yet other examples.

Additionally, in the second position P2, the tendency of the paper M to peel off from the endless belt 51 decreases as the bending angle of the endless belt 51 decreases, namely, as the angle θ of the nip outlet portion 51*b* with respect to the reference plane R decreases. For this reason, the second angle of the nip outlet portion 51*b* of the endless belt 51 with respect to the reference plane R at the second position P2 of the endless belt 51 may be less than 10°, less than 5°, or less than 0°, depending on examples. Accordingly, the controller 70 may set the angle θ of the nip outlet portion 51*b* with respect to the reference plane R in the second position P2 to less than 10° in some examples, less than 5° in other examples, or less than 0° in yet other examples. It should be noted that a force of allowing the paper M to be peeled off from the endless belt 51 acts on the paper M even when the paper M is not peeled off from the endless belt 51 when exiting the nip region NR if the angle θ of the nip outlet portion 51*b* with respect to the reference plane R is 0° or more. For this reason, the second angle may be less than 0° (e.g., a negative angle with the reference plane R, toward the inner peripheral side of the endless belt 51), in order to increase the quality of gloss processing.

Even when the angle θ of the nip outlet portion 51*b* with respect to the reference plane R is the same, the paper M is either separated or not separated from the endless belt 51 when exiting the nip region NR depending on various factors such as temperature and humidity. For this reason, a difference between the first angle and the second angle may be significant. For example, a difference between the first angle and the second angle may be 10° or more in some examples, 12° or more in other examples, or 14° or more in yet other examples. Namely, the controller 70 may set the angle θ of the nip outlet portion 51*b* with respect to the reference plane R, so that a difference between the first angle θ associated with the first position P1 and the second angle θ associated with the second position P2 is 10° or more in some examples, 12° or more in other examples, or 14° or more in yet other examples.

Incidentally, when the toner image is fixed to the paper M due to the heating and pressing in the nip region NR, the paper M is likely to be curled toward the toner image of the paper M, namely, forming a concave shape on the side of the paper M that faces the endless belt 51. Since a clear toner image using a clear toner is often formed on the entire surface or a part of the paper M, for example when performing gloss processing, the curvature of the paper M increases in comparison to a case in which gloss processing is not performed. For this reason, given a tangent T (see FIG. 9) of the heating roller 52 at the second end NR2 of the nip region NR, the controller 70 may set the nip outlet portion 51*b* to extend toward a side of the tangent T that faces the pressing roller 53, in the second position P2 when receiving a print instruction to perform gloss processing. In this case, the controller 70 may set a position in which the angle of the nip outlet portion 51*b* with respect to the tangent T of the heating roller 52 at the second end NR2 of the nip region NR is 0° or more. 5° or more, or 10 or more, depending on examples, as the second position P2 when a print instruction of performing gloss processing is generated. Namely, the second angle of 0° or more, 5° or more, or 10° or more may be formed, depending on examples, with respect to the tangent T of the heating roller 52 at the second end NR2 of the nip region NR at the second position P2. Accordingly, the curl in the paper M is corrected by bending the paper M in a direction opposite to the curl direction at the second end NR2 of the nip region N R.

Further, the degree of curvature of the curl formed on the paper M may vary depending on the weight of the paper M, the amount of the toner forming the toner image (e.g., the amount of the clear toner), the area of the toner image (e.g., the area of the toner image including the clear toner), and the like. For this reason, the controller 70 may vary the angle of the nip outlet portion 51*b* with respect to the tangent T at the second position P2 in accordance with the weight of the paper M, the amount of the toner forming the toner image (e.g., the amount of the clear toner), the area of the toner image (e.g., the area of the toner image of the clear toner), and the like, in order to correct the curl in the paper M.

An example operation of the fixing device 50 will be described.

With reference to FIG. 2, when a print instruction of not performing gloss processing is generated (e.g., a print instruction to bypass gloss processing), the controller 70 controls the driving of the conveyance switching device 56 so that the endless belt 51 is located at the first position P1. The paper M to which the toner image has been transferred, is conveyed by a rotation of the endless belt 51, from the first end NR1 of the nip region NR to the second end NR2 and is heated and pressed by the heating roller 52 and the pressing roller 53 in the nip region NR. From the second end NR2 of the nip region NR, the paper M is conveyed toward the first conveying path 57, so as to cause the paper M to peel off from the endless belt 51 immediately after being discharged from the second end NR2 of the nip region NR, The paper M is discharged from the discharge device 60 to the outside of the image forming apparatus 1.

With reference to FIG. 3, when a print instruction to perform gloss processing is generated, the controller 70 controls the driving of the conveyance switching device 56 so that the endless belt 51 is located at the second position P2. The paper M to which the toner image has been transferred, is conveyed by a rotation of the endless belt 51, from the first end NR1 of the nip region NR to the second end NR2 thereof, and is heated and pressed by the heating roller 52 and the pressing roller 53 at the nip region NR. Upon exiting the nip region NR, the paper M is conveyed to the gloss-forming path 51*c* of the endless belt 51 while the toner image remains in contact with the outer peripheral surface 51*a* of the endless belt 51 and is cooled by the cooling device 55. Accordingly, the toner image on the paper M is smoothened so as to impart gloss to the toner image. The paper M is conveyed toward the second conveying path 58, so as to cause the paper M to peel off from the endless belt 51 at a position facing the suspension roller 54 (e.g., where the endless belt is wound around the suspension roller 54). The paper M is discharged from the discharge device 60 to the outside of the image forming apparatus 1.

In this way, in the image forming apparatus 1, the conveyance switching device 56 can change the conveying path of the paper M discharged from the nip region NR by moving the endless belt 51 between the first position P1 and the second position P2, That is, when the endless belt 51 is in the first position P1, the paper M can be separated from the endless belt 51 immediately after the paper M exits the nip region NR. Additionally, when the endless belt 51 is in the second position P2, the paper M can be conveyed while remaining in contact with the endless belt 51 after the paper M exits the nip region NR. Accordingly, in the first position P1 of the endless belt 51, the gloss processing of the toner image is prevented (bypassed), and in the second position P2 of the endless belt 51, gloss processing is performed on the toner image on the paper M. Accordingly, a gloss-processed image or a non-gloss-processed image can be selective formed within a same fixing device 5, without a gloss processing device that is separate from the fixing device 5.

Further, the conveyance switching device 56 can easily move the endless belt 51 between the first position P1 and the second position P2 by changing the angle θ of the nip outlet portion 51*b* with respect to the reference plane R.

It should be understood that not all aspects, advantages, and features described herein may necessarily be achieved or included in, any one particular example. Indeed, having described and illustrated various examples herein, it should be apparent that other examples may be modified in arrangement and detail is omitted.

For example, the first belt roller which supports the endless belt 51 may be a pressing roller. In this case, the endless belt may extend around the pressing roller and the suspension roller, such that the pressing roller and the suspension roller are disposed inside the endless belt, and the heating roller may be disposed outside the endless belt adjacent the pressing roller.

The invention claimed is:

1. An image forming apparatus comprising:

a fixing device including:

an endless belt to convey a print medium, a heating roller to heat the endless belt, a pressing roller that presses the endless belt against the heating roller along a nip region of the endless belt, and a conveyance switching device to move the endless belt between a first position that directs the print medium away from the endless belt when the print medium exits the nip region to bypass gloss processing of a toner image on the print medium by the fixing device and form a non-gloss-processed image by the fixing device, and a second position that conveys the print medium to remain in contact with the endless belt when the print medium exits the nip region to perform gloss processing on the toner image on the print medium by the fixing device and form a gloss-processing image by the fixing device, the conveyance switching device to change an angle of a nip outlet portion of the nip region at the intersection between the heating roller and the pressing roller with respect to a reference plane to move the endless belt between the first position and the second position.

2. The image forming apparatus according to claim 1, wherein the fixing device includes a suspension roller, wherein the endless belt extends around a first belt roller corresponding to the heating roller or the pressing roller, and a second belt roller corresponding to the suspension roller, and wherein the endless belt includes the nip outlet portion that extends downstream an outlet of the nip region, in a conveyance direction of the endless belt from the first belt roller toward the second belt roller, the conveyance switching device to move the endless belt so as to vary the angle of the nip outlet portion with respect to the reference plane.

3. The image forming apparatus according to claim 2, comprising:

a cooling device disposed adjacent to the endless belt to cool the endless belt between the nip outlet portion and the suspension roller.

4. The image forming apparatus according to claim 2, wherein the conveyance switching device includes the suspension roller which is movable with respect to the first belt roller in order to vary the angle of the nip outlet portion of the endless belt.

5. The image forming apparatus according to claim 2, wherein the conveyance switching device includes a belt pressing device located inside the endless belt between the first belt roller and the suspension roller, and wherein the belt pressing device is movable toward and away from the endless belt so as to form a convex shape in the endless belt adjacent to the nip outlet portion in the first position when the belt pressing device is positioned to tension the endless belt, and so as to restore a linear shape of the endless belt adjacent to the nip outlet portion in the second position when the belt pressing device is spaced away from the endless belt.

6. The image forming apparatus according to claim 2, the nip outlet portion of the endless belt to form a first angle with respect to the reference plane, in the first position of the endless belt, the nip outlet portion of the endless belt to form a second angle with respect to the reference plane, in the second position of the endless belt, wherein a difference between the first angle and the second angle is 10° or more.

7. The image forming apparatus according to claim 2, wherein the nip region extends from a first end forming an inlet of the nip region to a second end forming an outlet of the nip region, and wherein the reference plane is oriented to include the first end and the second end of the nip region.

8. The image forming apparatus according to claim 7, wherein in the first position of the endless belt, the nip outlet portion of the endless belt forms a first angle of 10° or more with respect to the reference plane, toward an outer peripheral side of the endless belt, and wherein in the second position of the endless belt, the nip outlet portion of the endless belt forms a second angle with respect to the reference plane that measures less than the first angle.

9. The image forming apparatus according to claim 8, wherein the second angle is less than 0° so as to be formed on an opposite side of the reference plane with respect to the first angle.

10. The image forming apparatus according to claim 1, wherein the endless belt includes a nip outlet portion that extends downstream from an outlet of the nip region, and wherein the fixing device includes a controller to operate the conveyance switching device to adjust an angle of the nip outlet portion with respect to the reference plane.

11. A fixing device comprising:

an endless belt to convey a print medium;

a pressure-heating device that engages the endless belt to fix a toner image to the print medium, the pressure-heating device including a pressing roller and a heating roller;

a suspension roller disposed inside the endless belt to convey the print medium along a gloss-forming path of the endless belt located between the pressure-heating device and the suspension roller; and a conveyance switching device to switch a conveyance direction for the print medium between a first conveyance direction that extends away from the gloss-forming path of the endless belt to bypass gloss processing of the toner image on the print medium by the fixing device and form a non-gloss-processed image by the fixing device, and a second conveyance direction that extends along the gloss-forming path of the endless belt to perform gloss processing on the toner image on the print medium by the fixing device and form a gloss-processing image by the fixing device, the conveyance switching device to change an angle of a nip outlet portion of a nip region at the intersection between the heating roller and the pressing roller with respect to a reference plane to move the endless belt between the first conveyance direction and the second conveyance direction.

12. The fixing device according to claim 11, wherein the pressure-heating device includes a heating roller disposed inside the endless belt to heat the endless belt and a pressing roller that presses the endless belt against the heating roller along the nip region of the endless belt, and wherein the first conveyance direction extends from an outlet of the nip region and away from the endless belt.

13. The fixing device according to claim 11, further comprising:

a cooling device which is disposed adjacent to the gloss-forming path of the endless belt to cool the gloss-forming path of the endless belt.

14. The fixing device according to claim 11, wherein the conveyance switching device includes the suspension roller, and wherein the suspension roller is movable with respect to the pressure-heating device to vary an angle of the gloss-forming path.

15. The fixing device according to claim 11, wherein the conveyance switching device includes a belt pressing device which is located inside the endless belt, and wherein the belt pressing device is movable toward and away from the endless belt to change an angle of the gloss-forming path.

* * * * *